US007192496B2

(12) United States Patent
Wojcik

(10) Patent No.: US 7,192,496 B2
(45) Date of Patent: Mar. 20, 2007

(54) METHODS OF PROCESSING NICKEL-TITANIUM ALLOYS

(75) Inventor: Craig Wojcik, Salem, OR (US)

(73) Assignee: ATI Properties, Inc., Albany, OR (US)

( * ) Notice: Subject to any disclaimer, the term of this patent is extended or adjusted under 35 U.S.C. 154(b) by 263 days.

(21) Appl. No.: 10/427,783

(22) Filed: May 1, 2003

(65) Prior Publication Data

US 2004/0216816 A1 Nov. 4, 2004

(51) Int. Cl.
*C22F 1/10* (2006.01)
*C22F 1/18* (2006.01)

(52) U.S. Cl. ..... 148/675; 148/669

(58) Field of Classification Search ..... None
See application file for complete search history.

(56) References Cited

U.S. PATENT DOCUMENTS 4,283,233 A 8/1981 Goldstein et al.
4,533,411 A 8/1985 Melton
4,631,094 A * 12/1986 Simpson et al. ..... 148/563
4,654,092 A 3/1987 Melton
4,707,196 A 11/1987 Honma et al.
4,770,725 A * 9/1988 Simpson et al. ..... 148/402
5,624,508 A 4/1997 Flomenblit et al.
5,843,244 A 12/1998 Pelton et al.
5,882,444 A 3/1999 Flomenblit et al.
5,958,159 A 9/1999 Prandi
6,001,195 A 12/1999 Kajiwara et al.
6,149,742 A * 11/2000 Carpenter et al. ..... 148/563
6,428,634 B1 * 8/2002 Besselink et al. ..... 148/421
6,540,849 B2 4/2003 DiCarlo et al.
6,946,040 B2 * 9/2005 Homma ..... 148/563
2002/0185200 A1 12/2002 DiCarlo et al.
2004/0177904 A1 9/2004 Kajiwara et al.

OTHER PUBLICATIONS

H. Horikawa et al., "Reversible Characteristic Changes in Yield Stresses of a NiTi Alloy," *Proceedings of the MRS International Meeting of Advanced Materials*, vol. 9, *Shape Memory Alloys*, 1989, pp. 195-200, Materials Research Society, Pittsburgh, PA.
J. Uchil et al., "Study of Critical Dependence of Stable Phases in Nitinol on Heat Treatment Using Electrical Resistivity Probe," *Materials Science and Engineering A*, vol. 251, Nos. 1-2 (1998), pp. 58-63.
M. Nishida et al., "Precipitation Processes in Near-Equiatomic TiNi Shape Memory Alloys," *Metallurgical Transactions A*, vol. 17A, Sep. 1986, pp. 1505-1515.

(Continued)

*Primary Examiner*—John P. Sheehan
(74) *Attorney, Agent, or Firm*—K & L Gates

(57) ABSTRACT

Embodiments of the present invention provide methods of processing nickel-titanium alloys including from greater than 50 up to 55 atomic percent nickel to provide a desired austenite transformation temperature and/or austenite transformation temperature range. In one embodiment, the method comprises selecting a desired austenite transformation temperature, and thermally processing the nickel-titanium alloy to adjust an amount of nickel in solid solution in a TiNi phase of the alloy such that a stable austenite transformation temperature is reached, wherein the stable austenite transformation temperature is essentially equal to the desired austenite transformation temperature.

28 Claims, 6 Drawing Sheets

OTHER PUBLICATIONS

R.J. Wasilewski et al., "Homogenity Range and the Martensitic Transformation in TiNi," *Metallurgical Transactions,* vol. 2, Jan. 1971, pp. 229-238.

K. Otsuka and T. Kakeshita, "Science and Technology of Shape-Memory Alloys: New Developments," *MRS Bulletin,* Feb. 2002, pp. 91-100.

R.J. Wasilewski, "The Effects of Applied Stress on the Martensitic Transformation in TiNi," *Metallurgical Transactions,* vol. 2, Nov. 1971, pp. 2973-2981.

Y. Liu et al., "Asymmetry of Stress-Strain Curves Under Tension and Compression for NiTi Shape Memory Alloys," *Acta Meterailia,* vol. 46, No. 12 (1998), pp. 4325-4338.

S. Miyazaki et al., "The Habit Plane and Transformation Strains Associated with the Martensitic Transformation in TI-NI Single Crystals," *Scripta Metallurgica,* vol. 18 (1984), pp. 883-888.

H. Sehitoglu et al., "Compressive Response of NiTi Single Crystals," *Acta Materialia,* vol. 48, No. 13 (2000), pp. 3311-3326.

O. Matsumoto et al., "Crystallography of Martensitic Transformation in Ti-Ni Single Crystals," *Acta Metallurgica,* vol. 35, No. 8 (1987), pp. 2137-2144.

K. Gall et al., "The Role of Coherent Preciptiates in Martensitic Transformations in Single Crystal and Polycrystalline Ti-50.8at% Ni," *Scripta Materialia,* vol. 39, No. 6 (1998), pp. 699-705.

T. Tadaki et al., "Crystal Structure, Composition and Morphology of a Precipitate in an Aged Ti-51at%Ni Shape Memory Alloy," *Transactions of the Japan Institute of Metals,* vol. 27, No. 10 (1986), pp. 731-740.

*ASM Materials Engineering Dictionary,* J.R. Davis & Associates, eds., ASM International, United States of America, (1992), p. 339, 432.

* cited by examiner

METHODS OF PROCESSING NICKEL-TITANIUM ALLOYS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The various embodiments of the present invention generally relate to methods of processing nickel-titanium alloys. More particularly, certain embodiments of the present invention relate to thermally processing nickel-titanium alloys to predictably adjust the austenite transformation temperature and/or transformation temperature range of the alloy.

2. Description of Related Art

Equiatomic and near-equiatomic nickel-titanium alloys are known to possess both "shape memory" and "superelastic" properties. More specifically, these alloys, which are commonly referred to as "Nitinol" alloys, are known to undergo a martensitic transformation from a parent phase (commonly referred to as the austenite phase) to at least one martensite phase on cooling to a temperature below the martensite start (or "$M_s$") temperature of the alloy. This transformation is complete on cooling to the martensite finish (or "$M_f$") temperature of the alloy. Further, the transformation is reversible when the material is heated to a temperature above its austenite finish (or "$A_f$") temperature. This reversible martensitic transformation gives rise to the shape memory properties of the alloy. For example, a nickel-titanium alloy can be formed into a first shape while in the austenite phase (i.e., above the austenite finish temperature, or $A_f$, of the alloy), and subsequently cooled to a temperature below the $M_f$ and formed into a second shape. As long as the material remains below the $A_s$ (i.e., the temperature at which the transition to austenite begins or the austenite start temperature) of the alloy, the alloy will retain the second shape. However, if the alloy is heated to a temperature above the $A_f$ the alloy will revert back to the first shape.

The transformation between the austenite and martensite phases also gives rise to the "superelastic" properties of nickel-titanium alloys. When a nickel-titanium alloy is strained at a temperature above $M_s$, the alloy can undergo a strain-induced transformation from the austenite phase to the martensite phase. This transformation, combined with the ability of the martensite phase to deform by movement of twinned boundaries without the generation of dislocations, permits the nickel-titanium alloy to absorb a large amount of strain energy by elastic deformation without plastically (i.e., permanently) deforming. When the strain is removed, the alloy is able to almost fully revert back to its unstrained condition.

The ability to make commercial use of the unique properties of nickel-titanium alloys, and other shape memory alloys, is to a great extent dependent upon the temperatures at which these transformations occur, i.e, the $A_s$ and $A_f$, and $M_s$ and $M_f$ of the alloy, as well as the range of temperatures over which these transformations occur. However, in binary nickel-titanium alloy systems, it has been observed that the transformation temperatures of the alloy are highly dependent on composition. That is, for example, it has been observed that the $M_s$ temperature of a nickel-titanium alloy can change more than 100K for a 1 atomic percent change in composition of the alloy. See K. Otsuka and T. Kakeshia, "Science and Technology of Shape-Memory Alloys: New Developments," MRS Bulletin, February 2002, at pages 91–100.

Further, as will be appreciated by those skilled in the art, the tight compositional control of nickel-titanium alloys necessary to achieve predictable transformation temperatures is extremely difficult to achieve. For example, in order to achieve a desired transformation temperature in a typical nickel-titanium process, after a nickel-titanium ingot or billet is cast, the transformation temperature of the ingot must be measured. If the transformation temperature is not the desired transformation temperature, the composition of the ingot must be adjusted by remelting and alloying the ingot. Further, if the ingot is compositionally segregated, which may occur for example during solidification, the transformation temperature of several regions across the ingot must be measured and the transformation temperature in each region must be adjusted. This process must be repeated until the desired transformation temperature is achieved. As will be appreciated by those skilled in the art, such methods of controlling transformation temperature by controlling composition are both time consuming and expensive. As used herein, the term "transformation temperature(s)" refers generally to any of the transformation temperatures discussed above; whereas the term "austenite transformation temperature(s)" refers to at least one of the austenite start ($A_s$) or austenite finish ($A_f$) temperatures of the alloy, unless specifically noted.

Methods of generally increasing or decreasing the transformation temperatures of nickel-titanium alloys using thermal processes are known in the art. For example, U.S. Pat. No. 5,882,444 to Flomenblit et al. discloses a memorizing treatment for a two-way shape memory alloy, which involves forming a nickel-titanium alloy into a shape to be assumed in the austenitic phase, and then polygonizing the alloy by heating at 450° C. to 550° C. for 0.5 to 2.0 hours, solution treating the alloy at 600° C. to 800° C. for 2 to 50 minutes, and finally aging at about 350° C. to 500° C. for about 0 to 2.5 hours. According to Flomenblit et al., after this treatment, the alloy should have an $A_f$ ranging from 10° C.–60° C. and a transformation temperature range (i.e., $A_f$–$A_s$) of 1° C. to 5° C. Thereafter, the $A_f$ of the alloy may be increased by aging the alloy at a temperature of about 350° C. to 500° C. Alternatively, the alloy may be solution treated at a temperature of about 510° C. to 800° C. to decrease the $A_f$ of the alloy. See Flomenblit et al. at col. 3, lines 47–53.

U.S. Pat. No. 5,843,244 to Pelton et al. discloses a method of treating a component formed from a nickel-titanium alloy to decrease the $A_f$ of the alloy by exposing the component to a temperature greater than a temperature to which it is exposed to shape-set the alloy and less than the solvus temperature of the alloy for not more than 10 minutes to reduce the $A_f$ of the alloy.

However, there remains a need for an efficient method of predictably controlling the austenite transformation temperatures and/or austenite transformation temperature range of nickel-titanium alloys to achieve a desired austenite transformation temperature and/or austenite transformation temperature range. Further, there remains a need for a method of predictably controlling the austenite transformation temperatures and austenite transformation temperature range of nickel-titanium alloys having varying nickel contents.

BRIEF SUMMARY OF THE INVENTION

Embodiments of the present invention provide methods of processing nickel-titanium alloys to achieve a desired austenite transformation temperature. For example, one non-limiting method of processing a nickel-titanium alloy comprising from greater than 50 up to 55 atomic percent nickel to provide a desired austenite transformation temperature comprises selecting the desired austenite transformation temperature, and thermally processing the nickel-titanium alloy to adjust an amount of nickel in solid solution in a TiNi phase of the alloy such that a stable austenite transformation temperature is reached during thermally processing the nickel-titanium alloy, wherein the stable austenite transformation temperature is essentially equal to the desired austenite transformation temperature.

Another non-limiting method of processing a nickel-titanium alloy to provide a desired austenite transformation temperature comprises selecting a nickel-titanium alloy comprising from greater than 50 up to 55 atomic percent nickel, selecting the desired austenite transformation temperature, and thermally processing the selected nickel-titanium alloy to adjust an amount of nickel in solid solution in a TiNi phase of the alloy such that a stable austenite transformation temperature is reached during thermally processing the selected nickel-titanium alloy, the stable austenite transformation temperature being essentially equal to the desired austenite transformation temperature, wherein the selected nickel-titanium alloy comprises sufficient nickel to reach a solid solubility limit during thermally processing the selected nickel-titanium alloy.

Still another non-limiting method of processing two or more nickel-titanium alloys having varying compositions comprising from greater than 50 up to 55 atomic percent nickel to achieve a desired austenite transformation temperature comprises selecting the desired austenite transformation temperature, and subjecting the nickel-titanium alloys to similar thermal processing such that after thermal processing, the nickel-titanium alloys have stable austenite transformation temperatures, the stable austenite transformation temperatures being essentially equal to the desired austenite transformation temperature.

Another non-limiting method of processing a nickel-titanium alloy including regions of varying composition comprising from greater than 50 up to 55 atomic percent nickel such that each region has a desired austenite transformation temperature comprises thermally processing the nickel-titanium alloy to adjust an amount of nickel in solid solution in a TiNi phase of the alloy in each region of the nickel-titanium alloy, wherein after thermally processing the nickel-titanium alloy, each of the regions of the nickel-titanium alloy has a stable austenite transformation temperature that is essentially equal to the desired austenite transformation temperature.

Embodiments of the present invention also provide methods of processing nickel-titanium alloys to achieve a desired austenite transformation temperature range. For example, one non-limiting method of processing a nickel-titanium alloy comprising from greater than 50 up to 55 atomic percent nickel to achieve a desired austenite transition temperature range comprises isothermally aging the nickel-titanium alloy in a furnace at a temperature ranging from 500° C. to 800° C. for at least 2 hours, wherein after aging the nickel-titanium alloy has an austenite transformation temperature range no greater than 15° C.

Another non-limiting method of processing a nickel-titanium alloy including regions of varying composition comprising from greater than 50 up to 55 atomic percent nickel such that each region has a desired austenite transformation temperature range comprises isothermally aging the nickel-titanium alloy to adjust an amount of nickel in solid solution in a TiNi phase of the alloy in each region of the nickel-titanium alloy, wherein after isothermally aging the nickel-titanium alloy, each of the regions of the nickel-titanium alloy has an austenite transformation temperature range of no greater than 15° C.

Still another non-limiting method of processing a nickel-titanium alloy comprising from greater than 50 up to 55 atomic percent nickel to achieve a desired austenite transformation temperature range comprises isothermally aging the nickel-titanium alloy in a furnace at a first aging temperature to achieve a stable austenite transformation temperature, and isothermally aging the nickel-titanium alloy at a second aging temperature that is different than the first aging temperature, wherein after aging at the second aging temperature, the nickel-titanium alloy has an austenite transformation temperature range that is essentially equal to the desired transformation temperature range.

BRIEF DESCRIPTION OF THE SEVERAL VIEWS OF THE DRAWING(S)

The various embodiments of the present invention will be better understood when read in conjunction with the drawings, in which.

DETAILED DESCRIPTION OF THE INVENTION

Figure 1:
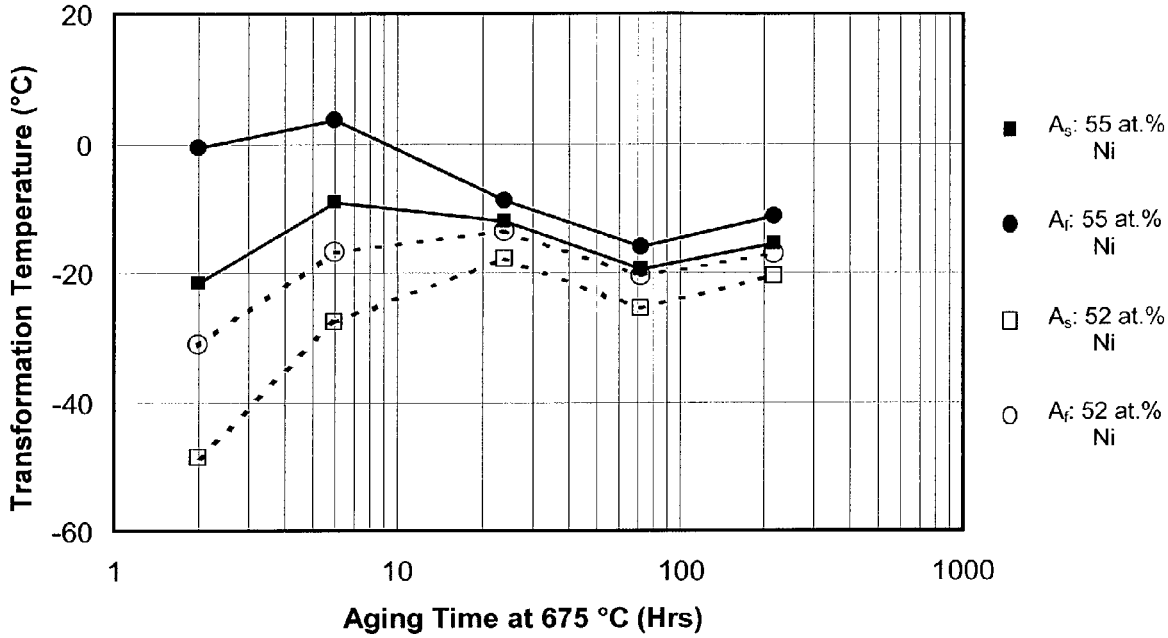
FIG. 1 is a schematic graph of the austenite transformation temperatures versus aging time at 675° C. for two different nickel-titanium alloys.

As previously discussed, typically, the austenite transformation temperatures of bulk nickel-titanium alloys are adjusted by adjusting the composition of the alloy. However, because the austenite transformation temperatures of nickel-titanium alloys are sensitive to minor compositional variations, attempts to control the austenite transformation temperatures through composition have proven to be both time consuming and expensive. Moreover, where the bulk alloy is compositionally segregated, which can occur, for example, during solidification, adjusting the austenite transformation temperatures of the alloy can require numerous compositional adjustments. In contrast, the methods of processing nickel-titanium alloys according to various embodiments of the present invention can be advantageous in providing efficient methods of predictably controlling the austenite transformation temperatures and/or austenite transformation temperature range of nickel-titanium alloys to achieve a desired austenite transformation temperature and/or austenite transformation temperature range, without the need for compositional adjustments. Further, the methods according to various embodiments of the present invention can be advantageous in providing efficient methods of predictably controlling the austenite transformation temperatures and/or austenite transformation temperature range for nickel-titanium alloys having varying nickel contents, for example, when the bulk alloy is compositionally segregated or where different alloys are processed simultaneously. Other advantages of the methods of processing nickel-titanium alloys according to certain embodiments of the present invention can include increased tensile strength and hardness of the alloys.

It will be appreciated by those skilled in the art that the $A_s$ and $A_f$ of nickel-titanium alloys can be generally adjusted by exposing the nickel-titanium alloy to an elevated temperature for relatively short periods of time. For example, if the alloy is exposed to a temperature sufficient to cause the formation of nickel-rich precipitates, the transformation temperatures of the alloy will generally increase. In contrast, if the alloy is exposed to a temperature sufficient to cause nickel-rich precipitates to dissolve, (i.e., the nickel goes into solid solution in the TiNi phase), the transformation temperature of the alloy will generally decrease.

However, it has been observed by the inventor that the extent of the increase or decrease in the austenite transformation temperatures during thermal processing will depend on several factors, including, but not limited to the initial $A_s$ and $A_f$ of the alloy, the overall composition of the alloy, and the time and temperature to which it is exposed. For example, referring now to FIG. 1, there is shown a plot of austenite transformation temperature ($A_s$ and $A_f$) versus aging time at 675° C. for two nickel-titanium alloys, one containing 55 atomic percent nickel (represented by solid circles and squares), and the other containing 52 atomic percent nickel (represented by open circles and squares). As can be seen from the plot of FIG. 1, when these alloys are aged for 2 hours, the $A_s$ and $A_f$ for both alloys change substantially with increased aging time. However, after about 24 hours of aging, the changes in the $A_s$ (represented in FIG. 1 by squares) and $A_f$ (represented in FIG. 1 by circles) for both alloys with increased aging time are relatively small. For example, after 216 hours of aging, the austenite transformation temperatures fluctuate only slightly from the austenite transformation temperatures observed after 24 hours of aging. In other words, it appears that after aging these alloys at 675° C. for about 24 hours, stable austenite transformation temperatures (both $A_s$ and $A_f$) are achieved. As used herein the term "stable austenite transformation temperature" means the at least one of the austenite start ($A_s$) or austenite finish ($A_f$) temperatures of the nickel-titanium alloy achieved after thermal processing deviates no more than 10° C. upon thermally processing the nickel-titanium alloy under the same conditions for an additional 8 hours.

For example, although not limiting herein, after aging the 55 atomic percent nickel alloy ("55 at. % Ni") at 675° C. for 24 hours, the nickel-titanium alloy has an $A_s$ of about −12° C., and the 52 atomic percent nickel alloy ("52 at. % Ni") has an $A_s$ of about −18° C. After aging the 55 at. % Ni alloy at 675° C. for 24 hours, the nickel-titanium alloy has an $A_f$ of about −9° C., and the 52 at. % Ni alloy has an $A_f$ of about −14° C. When these alloys are aged for 216 hours at 675° C., neither the $A_s$ nor the $A_f$ of the individual alloys deviates more than 10° C. from the $A_s$ or $A_f$ of the alloys observed after 24 hours aging. In this particular non-limiting example, the $A_s$ and $A_f$ of the individual alloys after aging for 216 hours at 675° C. deviate less than about 5° C. from the $A_s$ and $A_f$ of the alloys observed after 24 hours aging at 675° C.

As discussed in more detail below, and while not intending to be bound by any particular theory, it is believed by the inventor that variability in the $A_s$ and $A_f$ of the alloys after aging for 2 hours can be largely attributed to the inability to achieve compositional equilibrium or near-equilibrium conditions within these alloys during this relatively short duration thermal process. Thus, as can be seen from the plot of FIG. 1, while non-equilibrium thermal processes can be used to generally increase (or decrease) the austenite transformation temperature of an alloy, they are not particularly useful in making predictable adjustments to the austenite transformation temperature of an alloy in order to achieve a desired austenite transformation temperature.

Referring again to FIG. 1, it can be seen that the austenite transformation temperatures of the alloys are dependent upon composition when the alloys are aged for less than about 24 hours. For example, after 2 hours aging at 675° C., the $A_s$ of the 55 at. % Ni alloy is about 27° C. higher than the $A_s$ of the 52 at. % Ni alloy; and the $A_f$ of the 55 at. % Ni alloy is about 30° C. higher than the $A_f$ of the 52 at. % Ni alloy. Even after 6 hours of aging at 675° C., the $A_s$ of the 55 at. % Ni alloy is about 19° C. higher than the $A_s$ of the 52 at. % Ni alloy; while the $A_f$ of the 55 at. % Ni alloy is about 21° C. higher than the $A_f$ of the 52 at. % Ni alloy. However, after about 24 hours of aging at 675° C., the difference between the $A_s$ of the 55 at. % Ni alloy and that of the 52 at. % Ni alloy decreases dramatically, as does the difference between the $A_f$ for both the alloys. Although not limiting herein, in this particular example after 24 hours aging at 675° C., the difference between austenite start temperatures between the two alloys is only about 6° C., whereas the difference between the austenite finish temperatures between the two alloys is about 5° C.

Thus, it appears that the austenite transformation temperatures achieved after aging these two alloys for about 24 hours at 675° C. are independent of overall composition of the alloys. As used herein, the term "independent of overall composition" means at least one of the austenite start ($A_s$) or austenite finish ($A_f$) temperatures of a nickel-titanium alloy after thermal processing is within 10° C. of any other nickel-titanium alloy similarly processed and having sufficient nickel to reach the solid solubility limit during thermal processing, as discussed below in more detail.

Consequently, as can be seen from the plot of FIG. 1, although relatively short duration thermal processes can be used to make general shifts in the austenite transformation temperatures of nickel-titanium alloys (i.e., generally increase or decrease the austenite transformation temperatures), they are not particularly useful in making predictable adjustments to the austenite transformation temperatures of nickel-titanium alloys in order to achieve a desired austenite transformation temperature that is independent of overall composition of the alloy.

As previously discussed, it is believed by the inventor that variability associated with relatively short duration thermal processes can be largely attributed to the non-equilibrium conditions achieved within the alloy during thermal processing. However, the inventor has observed that predictable and stable transformation temperatures, and in particular austenite transformation temperatures, can be achieved by thermally processing nickel-titanium alloys to achieve a compositional equilibrium or near-equilibrium condition within the alloy. More particularly, it has been observed by the inventor that nickel-titanium alloys can be thermally processed to achieve a stable austenite transformation temperature that is characteristic of the temperature at which the material is thermally processed, provided the nickel-titanium alloy has sufficient nickel to reach the solid solubility limit (discussed below) of nickel in the TiNi phase at the thermal processing temperature. Although not meaning to be bound by any particular theory or limit the present invention, it is believed that the stable austenite transformation temperatures observed after thermally processing the nickel-titanium alloys at a given temperature are characteristic of an equilibrium or near-equilibrium amount of nickel in solid solution in the TiNi phase at the thermal processing temperature.

Although not limiting herein, one skilled in the art will recognize that in binary nickel-titanium alloys, the maximum amount of nickel that can exist in a stable solid solution in the TiNi phase varies with temperature. In other words, the solid solubility limit of nickel in the TiNi phase varies with temperature. As used herein, the term "solid solubility limit" means the maximum amount of nickel that is retained in the TiNi phase at a given temperature. In other words, the solid solubility limit is the equilibrium amount of nickel that can exist in solid solution in the TiNi phase at a given temperature. For example, although not limiting herein, as will be understood by those skilled in the art, generally, the solid solubility limit of nickel in the TiNi phase is given by the solvus line separating the TiNi and TiNi+$TiNi_3$ phase fields in a Ti—Ni equilibrium phase diagram. See *ASM Materials Engineering Dictionary*, J. R. Davis, ed. ASM International, 1992 at page 432, which is hereby specifically incorporated by reference. A non-limiting example of one Ti—Ni phase diagram is shown in *K. Otsuka and T. Kakeshia* at page 96. However, alternative methods of determining the solid solubility limit of nickel in the TiNi phase will be apparent to those skilled in the art.

It will also be appreciated by those skilled in the art that if the amount of nickel in the TiNi phase exceeds the solid solubility limit of nickel in the TiNi phase (i.e., the TiNi phase is supersaturated with nickel) at a given temperature, nickel will tend to precipitate out of solution to form one or more nickel-rich precipitates, thereby relieving the supersaturation. However, because the diffusion rates in the Ti—Ni system can be slow, the supersaturation is not instantaneously relieved. Instead, it can take a substantial amount of time for equilibrium conditions in the alloy to be reached. Conversely, if the amount of nickel in the TiNi phase is less than the solid solubility limit at a given temperature, nickel will diffuse into the TiNi phase until the solid solubility limit is reached. Again, it can take a substantial amount of time for equilibrium conditions in the alloy to be reached.

Further, when nickel precipitates out of the TiNi phase to form nickel-rich precipitates, both the hardness and the ultimate tensile strength of the alloy can be increased due to the presence of the nickel-precipitates distributed throughout the alloy. This increase in strength is commonly referred to as "age hardening" or "precipitation hardening." See *ASM Materials Engineering Dictionary* at page 339.

As previously discussed, the transformation temperatures of a nickel-titanium alloy are strongly influenced by the composition of the alloy. In particular, it has been observed that the amount of nickel in solution in the TiNi phase of a nickel-titanium alloy will strongly influence the transformation temperatures of the alloy. For example, it has been observed that the $M_s$ of a nickel-titanium alloy will generally decrease with increasing amounts of nickel in solid solution in the TiNi phase of the alloy; whereas the $M_s$ of a nickel-titanium alloy will generally increase with decreasing amounts of nickel in solid solution in the TiNi phase of the alloy. See R. J. Wasilewski et al., "Homogenity Range and the Martensitic Transformation in TiNi," *Metallurgical Transactions*, Vol. 2, January 1971 at pages 229–238.

However, although not meant to be bound by any particular theory, it is believed by the inventor that when an equilibrium or near-equilibrium amount of nickel exists in solid solution in the TiNi phase of a nickel-titanium alloy at a given temperature, the alloy will have a stable austenite transformation temperature that is characteristic of the given temperature, regardless of the overall composition of the alloy. In other words, so long as sufficient nickel is present in the nickel-titanium alloy to reach the solid solubility limit of nickel in the TiNi phase of the alloy at a given thermal processing temperature, all nickel-titanium alloys should have essentially the same austenite transformation temperature after thermally processing the alloys at a particular thermal processing temperature to achieve a equilibrium or near-equilibrium amount of nickel in solid solution in the TiNi phase of the alloys at the thermal processing temperature. Therefore, the stable austenite transformation temperature reached after thermally processing a nickel-titanium alloy is characteristic of an equilibrium or near-equilibrium amount of nickel in solid solution in the TiNi phase of the alloy at the particular thermal processing temperature.

Consequently, although not limiting herein, as the amount of nickel in solid solution in the TiNi phase of a nickel-titanium alloy approaches the equilibrium amount (i.e. the solid solubility limit) at a given temperature, the less the austenite transformation temperature of the alloy should fluctuate with additional thermal processing at that temperature. In other words, a stable austenite transformation temperature that is characteristic of a compositional equilibrium or near-equilibrium condition within the alloy will be observed.

It will also be appreciated by those skilled in the art that if, after thermal processing, the alloy is cooled too slowly to room temperature, the equilibrium or near-equilibrium conditions achieved during thermal processing can be lost. Accordingly, it is generally desirable to cool the nickel-titanium alloys after thermal processing sufficiently quickly retain the equilibrium or near-equilibrium conditions achieved during thermal processing. For example, after thermal processing the alloy, the alloy can be air cooled, liquid quenched, or air quenched.

Figure 2:
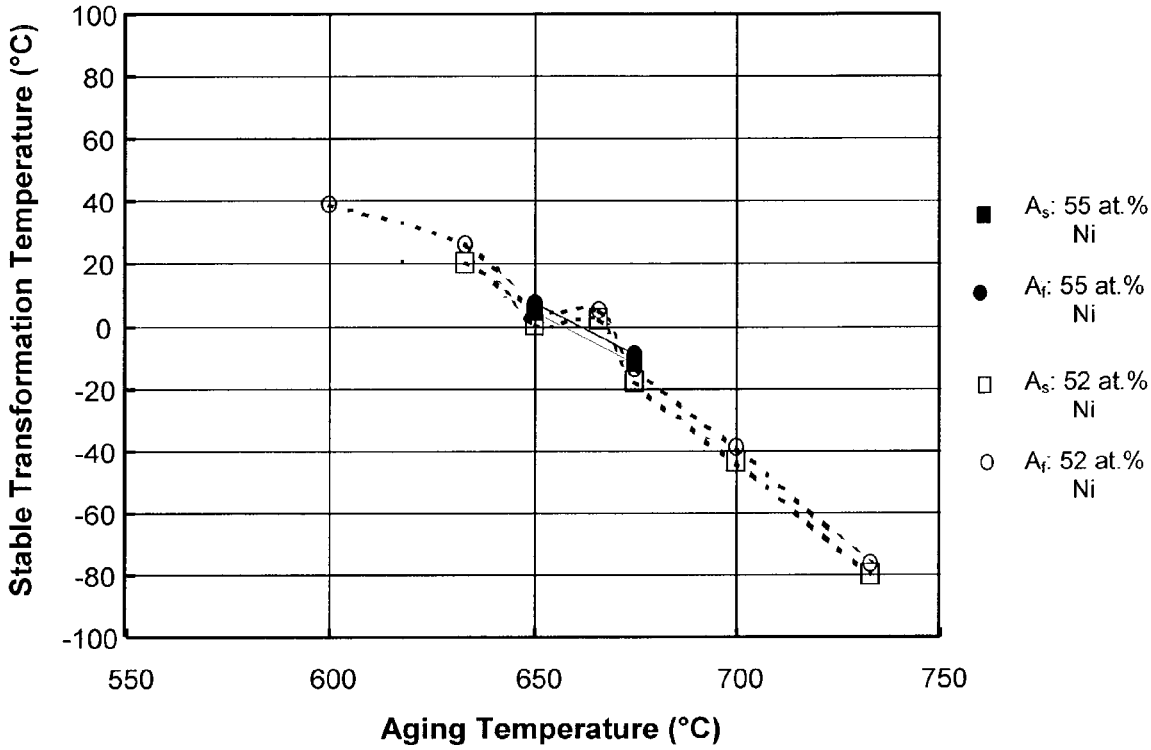
FIG. 2 is a schematic graph of the stable austenite transformation temperature versus aging temperature for two different nickel-titanium alloys.

Referring now to FIG. 2, there is shown a plot of stable austenite transformation temperature versus aging temperature for two nickel-titanium alloys containing varying amounts of nickel. The two nickel-titanium alloys were isothermally aged at the indicated temperatures for about 24 hours in order to achieve stable austenite transformation temperatures. As discussed above, the stable transformation temperatures are characteristic of an equilibrium or near-equilibrium amount of nickel in solid solution in the TiNi phase of the alloys at the thermal processing temperature.

Further, as can be seen from the plot of FIG. 2, it is possible to thermally process a nickel-titanium alloy to achieve a desired austenite transformation temperature by selecting a thermal processing temperature having associated with it a stable austenite transformation temperature essentially equal to the desired austenite transformation temperature, and then thermally processing the nickel-titanium alloy at that temperature to achieve the stable austenite transformation temperature. Since the stable austenite transformation temperature for a given thermal processing temperature can be readily determined (for example by isothermal aging studies), it is possible to predictably adjust the $A_s$ and $A_f$ of nickel-titanium alloys by thermally processing the nickel-titanium alloys to achieve compositional equilibrium or near-equilibrium conditions within the alloy. Additionally, as long as the nickel content of the alloy is sufficient to reach the solid solubility limit at the thermal processing temperature selected, the stable austenite transformation temperature achieved will be independent of overall composition of the alloy. As used herein with respect to transformation temperatures, the term "essentially equal" means that the transformation temperatures are within 10° C. or less of each other. Therefore, although not required, transformation temperatures that are essentially equal to each other can be equal to each other.

Various non-limiting embodiments of the present invention will now be described. It will be understood by those skilled in the art that the methods according to certain embodiments of the present invention can be utilized in conjunction with a variety of nickel-titanium alloy systems, as well as other alloy systems having properties sensitive to minor compositional variations; however, for clarity, aspects of the present invention have been described with reference to binary nickel-titanium alloy systems. Although not limiting herein, the methods according to certain embodiments of the present invention are believed to be useful in processing binary, ternary, and quaternary alloy systems comprising nickel and titanium in conjunction with at least one other alloying element. For example, ternary nickel-titanium alloy systems believed to be useful in various embodiments of the present invention include, but are not limited to: nickel-titanium-hafnium; nickel-titanium-copper; and nickel-titanium-iron alloy systems.

In one non-limiting embodiment of the present invention, a nickel-titanium alloy comprising from greater than 50 up to 55 atomic percent nickel is thermally processed to provide a desired austenite transformation temperature. More particularly, according to this embodiment of the present invention, the method comprises selecting a desired austenite transformation temperature, and thermally processing the nickel-titanium alloy to adjust an amount of nickel in solid solution in a TiNi phase of the alloy such that a stable austenite transformation temperature, which is essentially equal to the desired austenite transformation temperature, is reached during thermal processing. Further, as discussed above, as long as the amount of nickel present in the nickel-titanium alloy is sufficient to reach the solid solubility limit at the thermal processing temperature, the austenite transformation temperature achieved can be independent of overall composition of the alloy. Additionally, although not required, according to this non-limiting embodiment, the desired austenite transformation temperature can range from about −100° C. to about 100° C.

Although not meant to be limiting herein, the effect of thermal processing on the austenite transformation temperature of nickel-titanium alloys comprising 50 atomic percent or less nickel is believed to be too small to be commercially useful; whereas nickel-titanium alloys having greater than 55 atomic percent nickel are believed to be too brittle for commercial processing. However, those skilled in the art may recognize certain applications for which nickel-titanium alloys comprising greater than 55 atomic percent nickel are desirable. In such cases, alloys comprising greater than 55 atomic percent nickel may be utilized in conjunction with the various embodiments of the present invention. Theoretically, alloys comprising up to about 75 atomic percent nickel (i.e., within the TiNi+$TiNi_3$ phase field) should be capable of processing according to the various embodiments of the present invention; however, the time required to thermally process such high nickel alloys, as well as the brittle nature of these high nickel alloys, renders them not well suited for most commercial applications.

Another non-limiting embodiment of a method of processing a nickel-titanium alloy to provide a desired austenite transformation temperature according to the present invention comprises, selecting a nickel-titanium alloy comprising from greater than 50 up to 55 atomic percent nickel, selecting a desired austenite transformation temperature, and thermally processing the selected nickel-titanium alloy to adjust an amount of nickel in solid solution in a TiNi phase of the alloy, such that a stable austenite transformation temperature is reached during thermal processing, the stable austenite transformation temperature being essentially equal to the desired austenite transformation temperature. According to this non-limiting embodiment, the selected nickel-titanium alloy comprises sufficient nickel to reach a solid solubility limit during thermal processing. Further, according to this non-limiting embodiment, the stable austenite transformation temperature can be independent of overall composition of the alloy. Additionally, although not required, the desired austenite transformation temperature according to this non-limiting embodiment can range from about −100° C. to about 100° C.

In another non-limiting embodiment of the present invention, two or more nickel-titanium alloys having varying compositions and comprising from greater than 50 up to 55 atomic percent nickel are processed such that the alloys have a desired austenite transformation temperature. According to this non-limiting embodiment, the method comprises selecting a desired austenite transformation temperature, and subjecting the nickel-titanium alloys to similar thermal processing such that after thermal processing, the nickel-titanium alloys have stable austenite transformation temperatures that are essentially equal to the desired austenite transformation temperature. As previously discussed, as long as the nickel-titanium alloys have sufficient nickel to reach a solid solubility limit during thermal processing, the stable austenite transformation temperature of the alloys will be independent of overall composition of the alloys. Further, although not required, according to this non-limiting embodiment, the desired austenite transformation temperature can range from about −100° C. to about 100° C. As used herein the term "similar thermal processing" means that the nickel-titanium alloys are either processed together or processed separately, but using the same or similar processing parameters.

As previously discussed, during solidification of a nickel-titanium alloy, the alloy can become compositionally segregated. Typically, such compositional segregation can give rise to different transformation temperatures throughout the alloy. This generally requires that individual compositional adjustments be made throughout the alloy in order to achieve a uniform austenite transformation temperature. As will be appreciated by those skilled in the art, this requires complicated compositional adjustments to be made to the alloy. However, it has been found by the inventor that by thermally processing nickel-titanium alloys that are compositionally segregated according to various embodiments of the present invention, a uniform austenite transformation temperature throughout the alloy can be achieved without the need for such complicated compositional adjustments.

Accordingly, certain embodiments of the present invention provide methods of processing a nickel-titanium alloy including regions of varying composition comprising from greater than 50 up to 55 atomic percent nickel such that each region has a desired transformation temperature. More specifically, the method comprises thermally processing the nickel-titanium alloy to adjust an amount of nickel in solid solution in a TiNi phase in each region of the nickel-titanium alloy such that after thermally processing the nickel-titanium alloy, each of the regions of the nickel-titanium alloy has a stable austenite transformation temperature that is essentially equal to the desired austenite transformation temperature.

As previously discussed, precipitation of nickel from solid solution in the TiNi phase to form nickel-rich precipitates can increase the strength of the nickel-titanium alloy by precipitation hardening. Accordingly, in certain embodiments of the present invention wherein nickel-rich precipitates are formed during thermal processing, the thermally processed nickel-titanium alloys can advantageously possess increased tensile strength and/or increased hardness as compared to the alloys prior to thermal processing.

Suitable, non-limiting methods of thermally processing nickel-titanium alloys according to the foregoing, non-limiting embodiments of the present invention will now be discussed. Methods of thermally processing nickel-titanium alloys according to the various embodiments of the present invention include, but are not limited to, isothermal aging treatments, staged or stepped aging treatments, and controlled cooling treatments. As used herein, the term "isothermal aging" means holding the alloy in a furnace at a constant furnace temperature for a period of time. However, it will be appreciated by those skilled in the art that, due to the equipment limitations, minor fluctuations in furnace temperature can occur during isothermal aging treatments.

For example, in certain embodiment of the present invention, thermally processing the nickel-titanium alloy includes isothermally aging the nickel-titanium alloy. As previously discussed, the temperature at which the nickel-titanium alloy is thermally processed will depend upon the desired austenite transformation temperature. Thus, for example, in certain non-limiting embodiments of the present invention, wherein thermally processing the nickel-titanium alloy includes isothermally aging the nickel-titanium alloy, the isothermal aging temperature can range from 500° C. to 800° C.

Although not limiting herein, it is believed that although isothermal aging at temperatures below about 500° C. can be utilized in accordance with various embodiments of the present invention, the time required to achieve equilibrium or near-equilibrium conditions at aging temperature below about 500° C. is generally too long to be useful for many commercial applications. Further, isothermal aging at temperatures above about 800° C. can be utilized in accordance with various embodiments of the present invention; however, nickel-rich alloys aged at temperatures above about 800° C. tend to be too brittle to be useful in many commercial applications. However, those skilled in the art may recognize applications for which aging temperatures below about 500° C. or above about 800° C. can be useful. Accordingly, embodiments of the present invention contemplate thermally processing nickel-titanium alloys at temperatures below about 500° C. or above about 800° C.

It will be appreciated by those skilled in the art that the duration of the isothermal aging treatment required to achieve a stable austenite transformation temperature will vary depending, in part, on the configuration (or cross-sectional area) of the alloy (i.e, bars, wire, slabs, etc.), the aging temperature, as well as the overall nickel content of the alloy. For example, although not limiting herein, where super-fine nickel-titanium wire (i.e., wire with a diameter of less than about 0.03 inches) or nickel-titanium foil is thermally processed, isothermal aging times of at least 2 hours can be utilized in accordance with embodiments of the present invention. Where alloys with larger cross-sections are isothermally aged, aging time can be greater than 2 hours, and may be least 24 hours or more. Similarly, if alloys having smaller cross-sections are thermally processed, the isothermal aging time can be less than 2 hours.

Further, where the overall composition of the nickel-titanium alloy is very nickel-rich as compared to the solid solubility limit at the thermal processing temperature and/or relatively low thermal processing temperature is employed to achieve a desired austenite transformation temperature, the time required to achieve a stable austenite transformation temperature can be longer than desired for some commercial applications. However, it has been found by the inventors that the time required to achieve a stable austenite transformation temperature in very nickel-rich alloys and/or at low thermal processing temperatures can be reduced by employing a staged thermal process as described below.

More specifically, according to certain embodiments of the present invention, thermally processing the nickel-titanium alloy to achieve a stable austenite transformation temperature that is essentially equal to the desired austenite transformation temperature includes aging the nickel-titanium alloy at a first aging temperature and subsequently aging the nickel-titanium alloy at a second aging temperature, wherein the first aging temperature is higher than the second aging temperature. According to this embodiment, the second aging temperature is chosen so as to achieve the desired austenite transformation temperature as described in detail above. That is, after aging at the second aging temperature, the alloy will have a stable austenite transformation temperature that is essentially equal to the desired transformation temperature, and characteristic of a compositional equilibrium or near-equilibrium condition within the alloy at the second aging temperature.

While not intending to be bound by any particular theory, a first aging temperature that is higher than the second aging temperature, but below the solvus temperature of the alloy, is selected to increase the initial diffusion rate of nickel within the alloy. Thereafter, the desired austenite transformation temperature is achieved by aging the nickel-titanium alloy at a second aging temperature having a stable austenite transformation temperature essentially equal to the desired transformation temperature. Although not required, after aging at the second aging temperature, the nickel-titanium alloy can have an equilibrium amount of nickel in solid solution in the TiNi phase.

Figure 3:
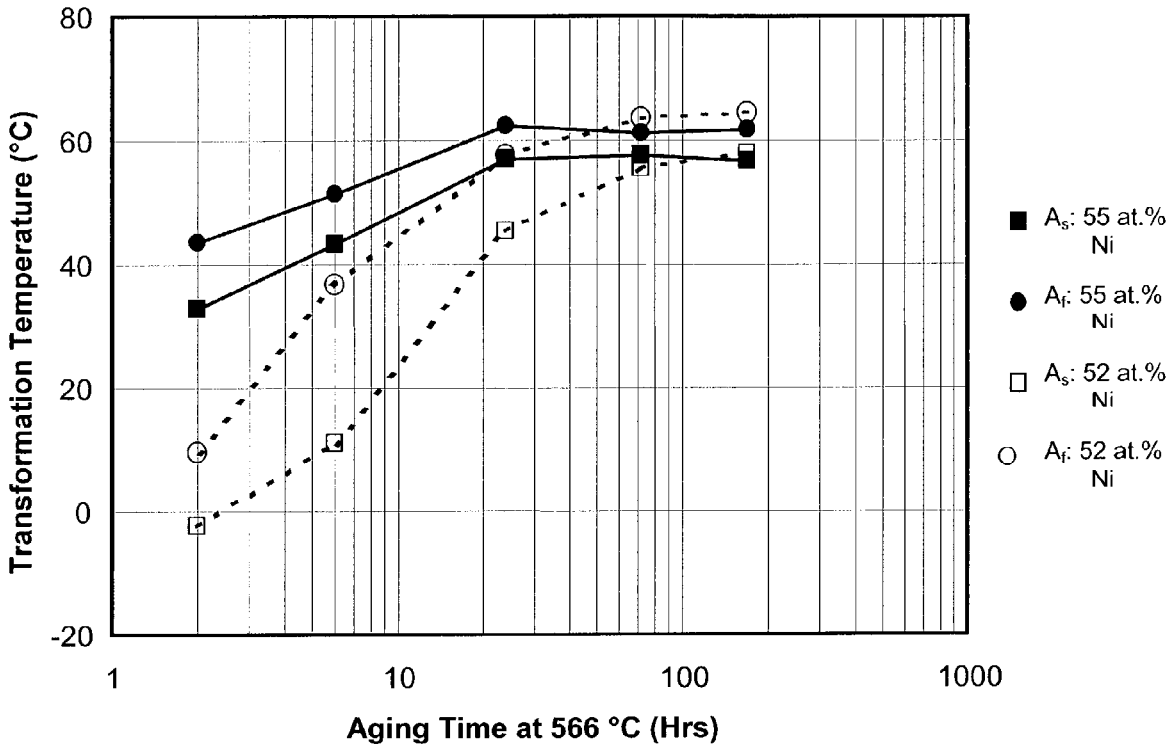
FIG. 3 is a schematic graph of the austenite transformation temperatures versus aging time at 566° C. for two different nickel-titanium alloys.

Referring now to FIG. 3, there is shown a plot of austenite transformation temperature versus aging time for two nickel-titanium alloys that were aged using a two-stage aging process. Although not indicated on the plot, prior to aging at 566° C., both alloys were aged for about 24 hours at 675° C. to increase the initial diffusion rate of nickel in the alloy. Thereafter, both alloys were aged at 566° C. as indicated by the plot of FIG. 3. As can be seen from the plot of FIG. 3, after about 72 hours, stable $A_s$ and $A_f$ temperatures, which are also independent of overall composition of the alloy, are achieved. In contrast, had the alloys been isothermally aged in one-stage aging process (i.e., at 566° C.

only), aging times in excess of 72 hours would have been required to achieve stable transformation temperatures due to the relatively low nickel diffusion at this temperature and relatively high nickel content In one non-limiting example of a two-stage aging process according to certain embodiments of the present invention, a nickel-titanium alloy is isothermally aged at a first aging temperature ranging from 600° C. to 800° C., and subsequently aged at a lower second aging temperature ranging from 500° C. to 600° C. Further, although not required, the nickel-titanium alloy can be aged at the first aging temperature for at least 2 hours and at the second aging temperature for at least 2 hours. As previously discussed, according to this embodiment, the stable austenite transformation temperature is achieved during aging at the second aging temperature.

It will also be appreciated by those skilled in the art that, as the excess nickel content of the nickel-titanium alloy diminishes, the driving force for nucleation of nickel-rich precipitates also diminishes. Further, if in order to achieve the desired austenite transformation temperature, the alloy is to be thermally processed at a temperature near the solvus temperature of the alloy, the driving force for and rate of nucleation of the nickel-rich precipitates will be quite low during thermal processing. Accordingly, the time required to achieve a stable austenite transformation temperature that is essentially equal to the desired austenite transformation temperature can be longer than desired for some commercial applications. However, it has been found by the inventor that by employing a two-stage thermal process, the time required to achieve the stable austenite transformation temperature can be reduced. More specifically, according to certain embodiments of the present invention, thermally processing the nickel-titanium alloy to achieve a stable austenite transformation temperature essentially equal to the desired austenite transformation temperature includes aging the nickel-titanium alloy at a first aging temperature and subsequently aging the nickel-titanium alloy at a second aging temperature, wherein the first aging temperature is lower than the second aging temperature.

While not intending to be bound by any particular theory, one skilled in the art will appreciate that the driving force for homogenous nucleation of nickel-rich precipitates from a supersaturated TiNi phase can be increased by decreasing the temperature of the alloy below the solvus temperature of the alloy, i.e, undercooling below the solvus temperature of the alloy. Thus, by utilizing a first aging temperature that is lower than the aging temperature needed to achieve the desired transformation temperature, the rate of nucleation of the nickel-rich precipitates can be increased. However, once the nuclei are generated at the first aging temperature, growth of the precipitates by diffusion of the nickel will occur more rapidly if the aging temperature is increased. Accordingly, after aging the nickel-titanium alloy at the first aging temperature, the nickel-titanium alloy is aged at a second aging temperature that is higher than the first aging temperature. More particularly, the second aging temperature is chosen such that the stable austenite transformation temperature reached during aging at the second aging temperature is essentially equal to the desired austenite transformation temperature.

By employing a two-stage aging process using a first aging temperature that is lower than the second aging temperature, it has been observed that the total aging time required to achieve a stable austenite transformation temperature essentially equal to a desired austenite transformation temperature can be reduced. In one specific non-limiting example of a two-stage aging process according to this embodiment of the present invention, a nickel-titanium alloy is isothermally aged at a first aging temperature ranging from 500° C. to 600° C., and subsequently aged at a second aging temperature ranging from 600° C. to 800° C. Further, although not required, the nickel-titanium alloy can be aged at the first aging temperature for at least 2 hours and at the second aging temperature for at least 2 hours. As previously discussed, according to this embodiment, the stable austenite transformation temperature is achieved during aging at the second aging temperature.

Methods of processing nickel-titanium alloys to achieve a desired transformation temperature range will now be discussed. As previously discussed, the utility of shape memory alloys depends upon the transformation temperatures of the alloy, as well as the transformation temperature range. As used herein, the term "transformation temperature range" means the difference between the start and finish temperatures for a given phase transformation for a given alloy (i.e., $A_f$–$A_s$ or $M_s$–$M_f$). As used herein, the term "austenite transformation temperature range" means the difference between the $A_s$ and $A_f$ temperature for a given alloy (i.e., $A_f$–$A_s$). Further, as used herein with respect to transformation temperature ranges, the term "essentially equal" means that the transformation temperature ranges are within 10° C. or less of each other. Therefore, although not required, transformation temperature ranges that are essentially equal to each other can be equal to each other.

Although not limiting herein, in some applications, a narrow austenite transformation temperature range is desired. Generally a narrow austenite transformation temperature range is desirable in applications that utilize the superelastic properties of the nickel-titanium alloys, for example, but not limited to, antenna wire and eyeglass frames. While in other applications, a broad austenite transformation temperature range is desired. Generally a broad austenite transformation temperature range is desirable in applications requiring different degrees of transformation at different temperatures, for example, but not limited to, temperature actuators.

Referring again to FIG. 1, as can be seen from the plot in this figures, as the aging time increases, the austenite transformation temperature range for both the 55 at. % Ni alloy and the 52 at. % Ni alloy decreases. For example, after aging the 52 at. % Ni alloy for 2 hours at 675° C., the alloy has an austenite transformation temperature range of about 18° C., and after 6 hours of aging, the austenite transformation temperature range is about 11° C. However, after 24 hours aging at 675° C., the 52 at. % Ni alloy has an austenite transformation temperature range of less than about 5° C. Further, as aging time increases beyond 24 hours, this austenite transformation temperature range does not change appreciably. Similarly, after aging the 55 at. % Ni alloy for 2 hours at 675° C., the alloy has an austenite transformation temperature range of about 21° C., and after 6 hours of aging, the austenite transformation temperature range is about 13° C. However, after 24 hours aging at 675° C., the 52 at. % Ni alloy has an austenite transformation temperature range of less than about 5° C. Further, as aging time increases beyond 24 hours, this austenite transformation temperature range does not change appreciably.

Figure 4:
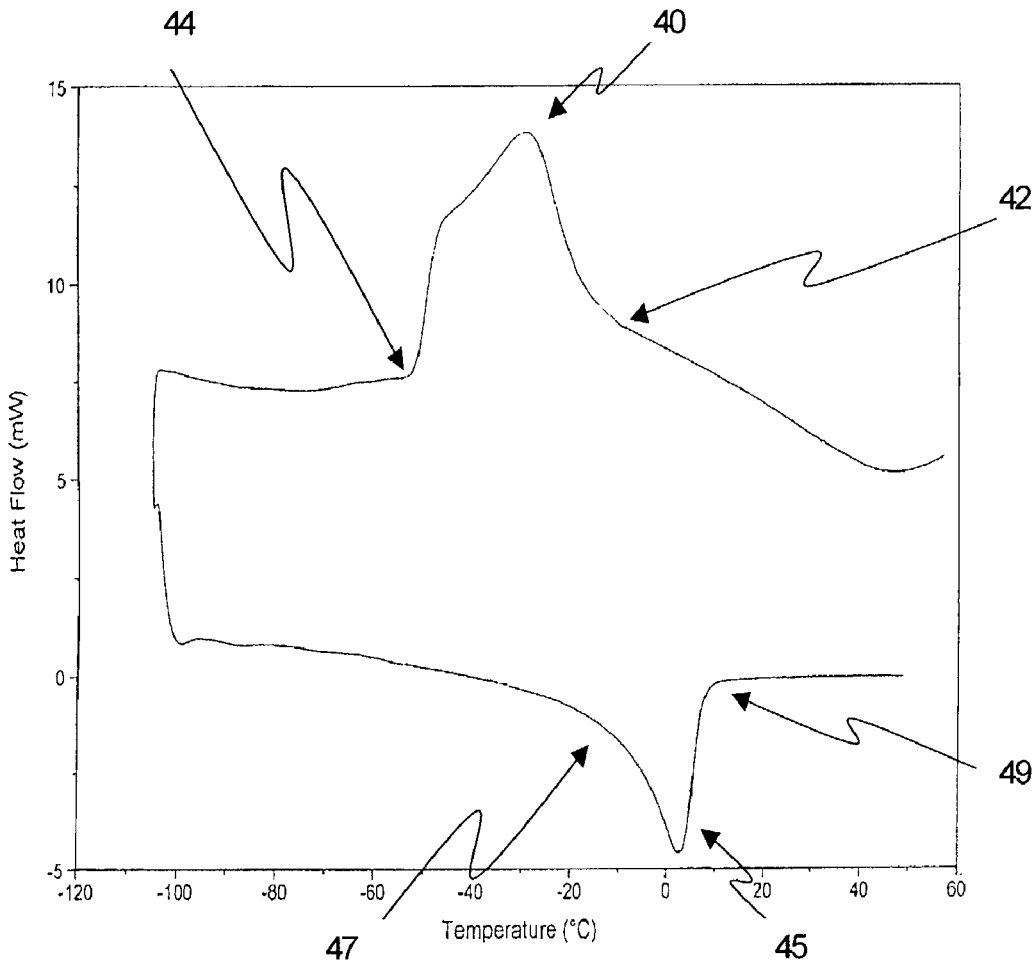
FIG. 4 is a schematic differential scanning calorimeter ("DSC") plot of a nickel-titanium alloy after 2 hours aging at 650° C.
Figure 5:
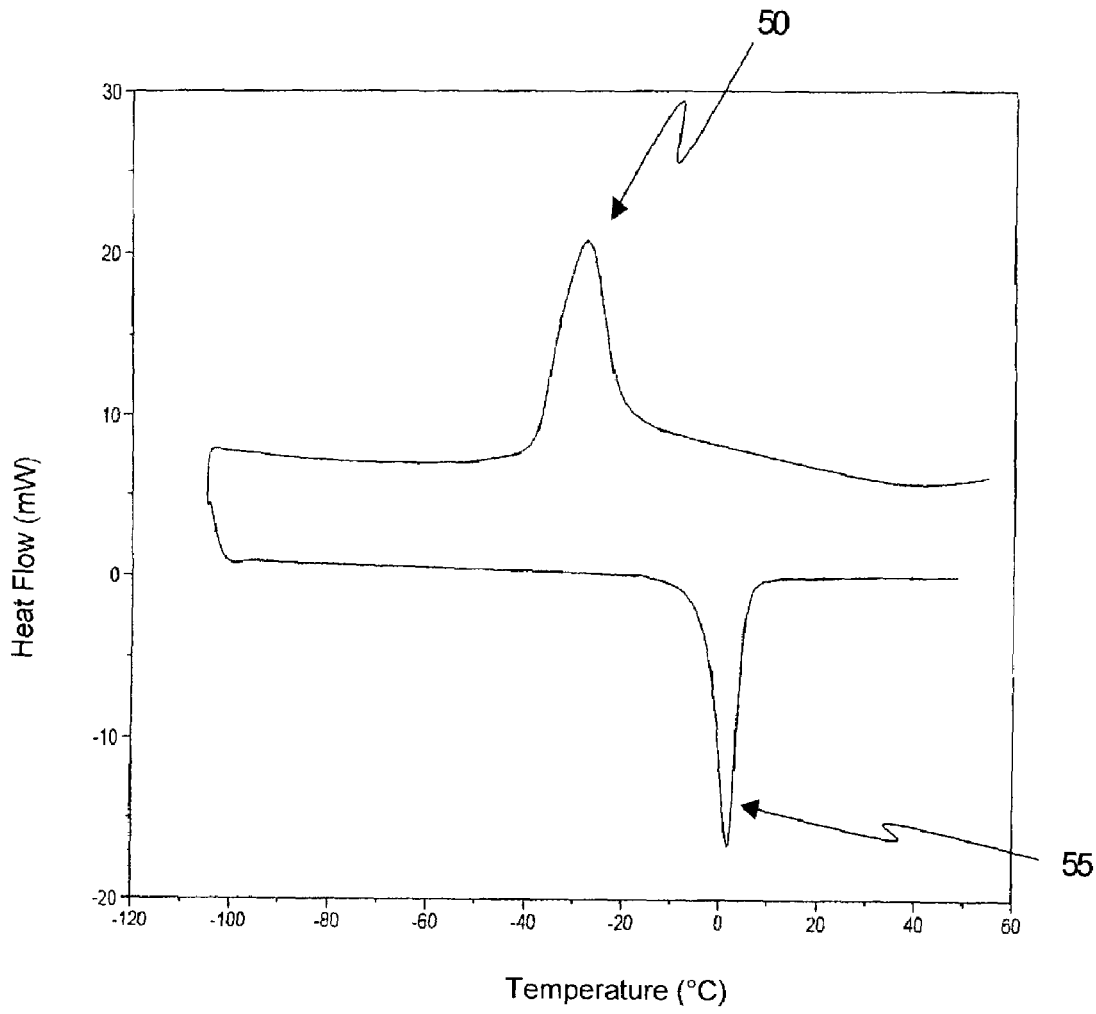
FIG. 5 is a schematic DSC plot of a nickel-titanium alloy after 24 hours aging at 650° C.
Figure 6:
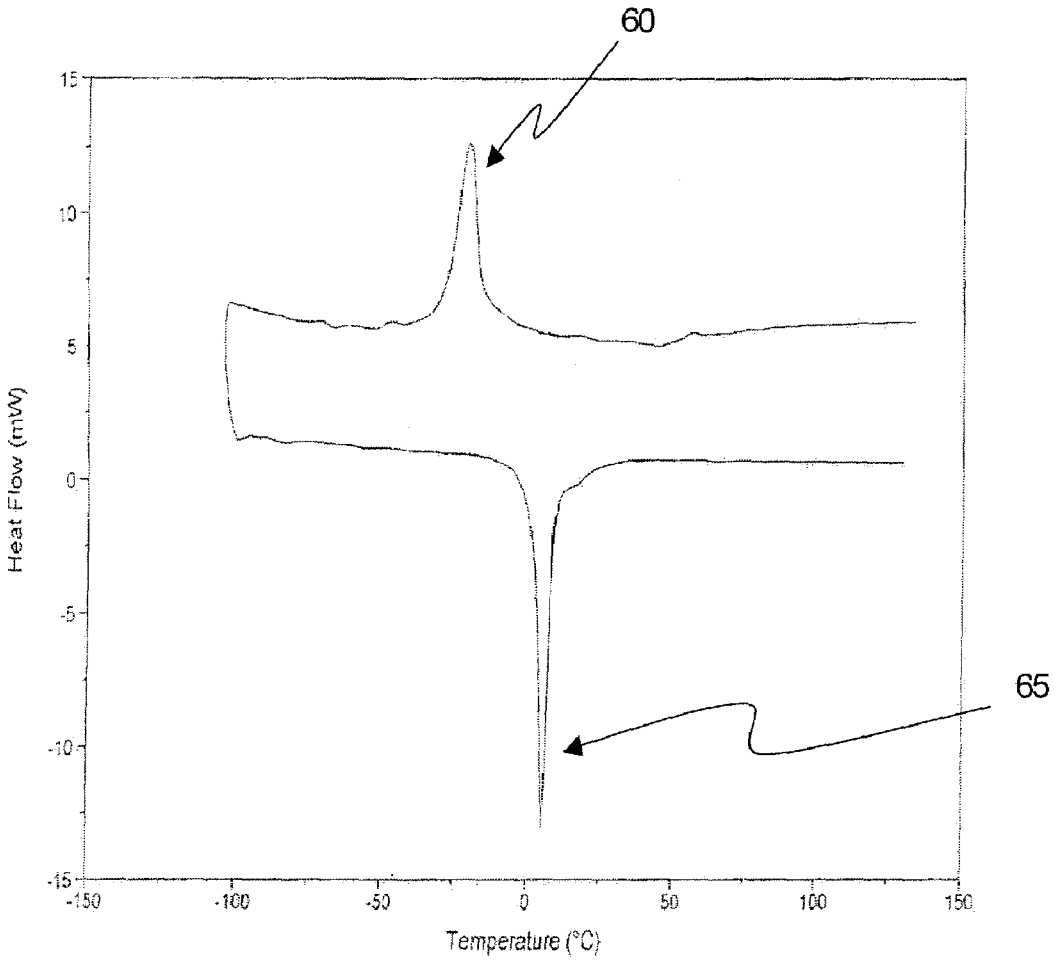
FIG. 6 is a schematic DSC plot of a nickel-titanium alloy after 216 hours aging at 650° C.

Referring now to FIGS. 4–6, there are shown three, schematic differential scanning calorimeter ("DSC") plots obtained for a nickel-titanium alloy comprising 55 atomic percent nickel. The DSC plot in FIG. 4 was obtained from a 55 atomic percent nickel alloy that was isothermally aged at 650° C. for 2 hours. The DSC plot in FIG. 5 was obtained after isothermally aging the 55 atomic percent nickel alloy at 650° C. for 24 hours, and the DSC plot in FIG. 6 was obtained after isothermally aging the 55 atomic percent nickel alloy at 650° C. for 216 hours.

Referring to FIG. 4, the upper peak, generally indicated as 40, represents the temperature range over which the martensitic transformation occurs on cooling the alloy. For example, as generally indicated in FIG. 4, the martensitic transformation starts at the $M_s$ temperature, generally indicated as 42, and is complete at the $M_f$ temperature, generally indicated as 44, of the alloy. The lower peak, generally indicated as 45, represents the temperature range over which the austenitic transformation occurs on heating the alloy. For example, as indicated in FIG. 4, the austenite transformation starts at the $A_s$ temperature, generally indicated as 47, and is complete at the $A_f$ temperature, generally indicated as 49, of the alloy.

As can been seen from the DSC plots in FIGS. 4–6, both the martensite and austenite transformation temperature ranges narrow with increasing aging time at 650° C. Thus, for example, upper peak 50 (in FIG. 5) is sharper and more narrow then upper peak 40 (in FIG. 4); and upper peak 60 (in FIG. 6) is sharper and more narrow than both upper peak 40 and upper peak 50. Similarly, lower peak 55 (in FIG. 5) is sharper and more narrow then lower peak 45 (in FIG. 4); and lower peak 65 (in FIG. 6) is sharper and more narrow than both lower peak 45 and lower peak 55.

As discussed above, along with the austenite transformation temperature, controlling the austenite transformation temperature range to a narrow interval is desirable in certain applications. Therefore, certain embodiments of the present invention provide methods of processing a nickel-titanium alloy comprising from greater than 50 up to 55 atomic percent nickel to achieve a desired austenite transformation temperature range. More specifically, the methods comprise isothermally aging the nickel-titanium alloy in a furnace at a temperature ranging from 500° C. to 800° C. for at least 2 hours, wherein after isothermally aging, the nickel-titanium alloy has an austenite transformation temperature range no greater than 15° C. Although not required, according to this non-limiting embodiment, the aging time can be at least 3 hours, at least 6 hours, and can be at least 24 hours depending upon, among other things, the desired austenite transformation temperature range. Further, according to this non-limiting embodiment, the austenite transformation temperature range achieved after isothermal aging can be no greater than 10° C., and can be no greater than 6° C., depending, in part, on the isothermal aging conditions.

Further, as previously discussed, nickel-titanium alloys can become compositionally segregated during solidification. Therefore, various embodiments of the present invention also contemplate methods of processing nickel-titanium alloys including regions of varying composition comprising from greater than 50 up to 55 atomic percent nickel, such that each region has a desired austenite transformation temperature range. According to these embodiments, the method comprises isothermally aging the nickel-titanium alloy to adjust an amount of nickel in solid solution in a TiNi phase in each region of the nickel-titanium alloy, wherein after isothermally aging the nickel-titanium alloy, each of the regions of the nickel-titanium alloy has an austenite transformation temperature range of no greater than 15° C. Although not required, according to this non-limiting embodiment, the aging time can be at least 2 hours, at least 3 hours, at least 6 hours, and at least 24 hours depending upon, among other things, the desired austenite transformation temperature range. Further, according to this non-limiting embodiment, the austenite transformation temperature range achieved after isothermal aging can be no greater than 10° C., and can be no greater than 6° C., depending, in part, on the isothermal aging conditions.

As also discussed above, along with the austenite transformation temperatures, controlling the austenite transformation temperature range to a broad interval is desirable in certain applications. Accordingly, certain embodiments of the present invention provide methods of processing a nickel-titanium alloy comprising from greater than 50 up to 55 atomic percent nickel to achieve a desired austenite transformation temperature and a desired transformation temperature range. More specifically, the method comprises aging the nickel-titanium alloy in a furnace at a first aging temperature to achieve a stable austenite transformation temperature, and subsequently aging the nickel-titanium alloy at a second aging temperature that is lower than the first aging temperature, wherein after aging the nickel-titanium alloy at the second aging temperature, the nickel-titanium alloy has an austenite transformation temperature range that is essentially equal to the desired austenite transformation temperature range. Further, according to this non-limiting embodiment, the transformation temperature range achieved on aging at the second aging temperature is greater than an austenite transformation temperature achieved on aging nickel-titanium alloy at a first aging temperature.

In another non-limiting embodiment of the present invention, the method of processing the nickel-titanium alloy comprising from greater than 50 up to 55 atomic percent nickel to achieve a desired transformation temperature range comprises aging the nickel-titanium alloy in a furnace at a first aging temperature to achieve a stable austenite transformation temperature, and subsequently aging the nickel-titanium alloy at a second aging temperature that is higher than the first aging temperature, wherein after aging at the second aging temperature, the nickel-titanium alloy has an austenite transformation temperature range that is essentially equal to the desired austenite transformation temperature range. Further, according to this non-limiting embodiment, the transformation temperature range achieved on aging at the second aging temperature is greater than an austenite transformation temperature achieved on aging nickel-titanium alloy at a first aging temperature.

Various embodiments of the present invention will now be illustrated by the following, non-limiting examples.

EXAMPLES

Example 1

Two nickel-titanium alloys, one containing approximately 52 atomic percent nickel and one containing approximately 55 atomic percent nickel, were prepared as follows. The pure nickel and titanium alloying additions necessary for each alloy were weighed and transferred to a vacuum arc remelting furnace. The alloys were then melted and subsequently cast into a rectangular slab. After casting, each nickel-titanium alloy was then hot worked to refine the grain structure. Attempts were then made to measure the austenite transformation temperatures (both $A_s$ and $A_f$) of the alloys prior to any aging treatments. However, because the alloys were compositionally segregated, the austenite transformation temperatures could not be determined. Thereafter, samples of each alloy were isothermally aged in a furnace for the times and temperatures shown in Table 1.

After each aging time interval, the austenite transformation temperatures for each alloy were determined using a bend free recovery test, which was conducted as follows. An initially flat specimen to be tested was cooled to a temperature approximately −196° C. (i.e., below $M_s$ of the alloy) by immersing the specimen in liquid nitrogen. Thereafter, the specimen was deformed in to an inverted "U" shape using a mandrel, which was also cooled by immersion in liquid nitrogen. The diameter of the mandrel was selected according to the following equation:

$$D_m = T/\epsilon - T$$

Where $D_m$ is the mandrel diameter, T is the thickness of the specimen, and $\epsilon$ is the percent strain desired, here, three percent. Thereafter, the specimen having the inverted "U" shape was placed directly under a linear variable differential transformer ("LVDT") probe in a bath of methanol and liquid nitrogen having a temperature approximately 10° C. below the suspected $A_s$ of the alloy. The bath containing the specimen and the LVDT probe were then and heated using a hot plate. As the specimen warmed in the bath, it began to revert back to it original shape (i.e., flat) once the temperature of the specimen reached the $A_s$ temperature of the alloy. The reversion to the initially flat shape was complete at the $A_f$ temperature of the alloy. Data corresponding to relative displacement of the specimen was collected using the LVDT probe as the specimen was warmed and the data was stored in a computer. A graph of displacement versus temperature was then plotted and the $A_s$ and $A_f$ temperature determined based on an approximation of the inflection points of the curve. In particular, the intersection points of three linear regression-fit lines corresponding to the three regions of the graph—i.e., the low temperature and high temperature regions where the graph of displacement versus temperature has relatively small slope, and the intermediate region where graph has a relatively large slope—were used to approximate the $A_s$ and $A_f$ temperatures of the specimen.

TABLE 1

| | | 52 at. % Ni | | | 55 at. % Ni | | |
|---|---|---|---|---|---|---|---|
| Isothermal Aging Temperature ° C. | Aging Time Hours | $A_s$ | $A_f$ | Austenite Transformation Temp. Range | $A_s$ | $A_f$ | Austenite Transformation Temp. Range |
| 675 | 2 | −49 | −31 | 18 | −22 | −1 | 21 |
| | 6 | −28 | −17 | 11 | −9 | 4 | 13 |
| | 24 | −18 | −14 | 4 | −12 | −9 | 3 |
| | 72 | −26 | −21 | 5 | −20 | −16 | 4 |
| | 216 | −21 | −17 | 4 | −16 | −11 | 5 |
| 650 | 2 | −88 | −56 | 32 | −12 | 7 | 19 |
| | 6 | −13 | 4 | 17 | 4 | 10 | 6 |
| | 24 | 0 | 5 | 5 | 5 | 7 | 2 |
| | 72 | 3 | 7 | 4 | 6 | 10 | 4 |
| | 216 | 10 | 12 | 2 | 11 | 17 | 6 |

As can be seen from Table 1, by aging either of the alloys for 24 hours stable austenite transformation temperatures (both $A_s$ and $A_f$) can be achieved, (i.e. the $A_s$ and $A_f$ of each of the alloys after 24 hours aging at 675° C. does not deviate more than 10° C. upon thermally processing the nickel-titanium alloy under the same conditions for an additional 8 hours.) Further, the stable austenite transformation temperatures achieved after 24 hours aging at 675° C. are also independent of overall composition of the nickel-titanium alloy. That is, the $A_s$ of the 55 at. % Ni alloy is within 10° C. of the $A_s$ of the 52 at. % Ni alloy after thermally processing the alloys at 675° C. for 24 hours; and the $A_f$ of the 55 at. % Ni alloy is within 10° C. of the $A_f$ of the 52 at. % Ni alloy after thermally processing the alloys at 675° C. for 24 hours. It is believed that the decrease in $A_s$ and $A_f$ observed after 72 hours aging at 675° C. is not representative and can be attributed to fluctuations in the furnace temperature during aging.

In comparison, although it appears after aging the alloys for 6 hours at 675° C., the $A_s$ and $A_f$ of the 52 at. % Ni alloy and the $A_s$ of the 55 at. % Ni alloy are stable, the austenite transformation temperatures are not independent of overall composition. Further, after 2 hours aging at 675° C., the austenite transformation temperature for both alloys are neither stable nor independent of overall composition.

Stable austenite transformation temperatures (both $A_s$ and $A_f$) can also be achieved for both alloys by aging the alloys for 24 hours at 650° C., (i.e. the $A_s$ and $A_f$ of each of the alloys after about 24 hours aging at 650° C. does not deviate more than 10° C. upon thermally processing the nickel-titanium alloy under the same conditions for an additional 8 hours.) Further, the stable austenite transformation temperatures achieved after 24 hours aging at 650° C. are also independent of overall composition of the nickel-titanium alloy. That is, the $A_s$ of the 55 at. % Ni alloy is within 10° C. of the $A_s$ of the 52 at. % Ni alloy after thermally processing the alloys at 650° C. for 24 hours; and the $A_f$ of the 55 at. % Ni alloy is within 110° C. of the $A_f$ of the 52 at. % Ni alloy after thermally processing the alloys at 650° C. for 24 hours.

In comparison, although it appears after aging the alloys for about 6 hours at 650° C. that the $A_f$ of the 52 at. % Ni alloy and the $A_s$ and $A_f$ of the 55 at. % Ni alloy are stable, the austenite start temperatures are not independent of overall composition. Further, after about 2 hours aging at 650° C., only the $A_f$ of the 55 at. % Ni alloy appears to be stable, but neither the $A_s$ nor the $A_f$ of the alloys is independent of overall composition of the alloys.

Although not limiting herein, it is believed that the initial amount of nickel in solid solution in the TiNi phase in the 55 at. % Ni alloy before aging was closer to the solid solubility limit of nickel in the TiNi phase at 650° C. than for the 52 at. % Ni alloy. Therefore, the aging time at 650° C. required to achieve stable austenite transformation temperatures for the 55 at. % nickel alloy was less than for the 52 at. % Ni alloy. However, as indicated by Table 1, austenite transformation temperatures that are both stable and independent of overall composition can be achieved by aging the alloys for 24 hours at 650° C. Therefore, the same thermal processing can be used for both alloys without regard to the initial condition of the alloy.

Further, as indicated in Table 1, the stable austenite transformation temperatures ($A_s$ and $A_f$) achieved after aging the nickel-titanium alloys for 24 hours at 675° C. are lower than the stable transformation temperatures achieved after aging the nickel-titanium alloys for 24 hours at 650° C. Although not meant to be bound by any particular theory, as previously discussed, this is believed to be attributable to the different solid solubility limit for nickel in the TiNi phase at 675° C. than at 650° C. In other words, the characteristic austenite transformation temperatures for nickel-titanium alloys having an equilibrium amount of nickel in solid solution in the TiNi phase at 675° C. are lower than the characteristic austenite transformation temperatures for nickel-titanium alloys having an equilibrium amount of nickel in solid solution in the TiNi phase at 650° C.

Moreover, as indicated in Table 1, the austenite transformation temperature range generally tends to narrow with increasing aging time at a given aging temperature for both alloys.

Example 2

Additional samples of the two alloys prepared according to Example 1 above were aged using the following two-stage aging process. The alloys were aged at a first aging temperature of about 675° C. for 24 hours and subsequently aged at a second aging temperature as indicated below in Table 2. After each aging time interval, the austenite transformation temperatures for each alloy were determined using the bend free recover test described above in Example 1.

TABLE 2

| Second Aging | | 52 at. % Ni | | | 55 at. % Ni | | |
|---|---|---|---|---|---|---|---|
| Temperature ° C. | Aging Time Hours | $A_s$ | $A_f$ | Austenite Transformation Temp. Range | $A_s$ | $A_f$ | Austenite Transformation Temp. Range |
| 600 | 2 | 11 | 26 | 15 | 27 | 35 | 8 |
| | 6 | 19 | 31 | 12 | 33 | 37 | 4 |
| | 24 | 30 | 38 | 8 | 33 | 43 | 10 |
| | 72 | 35 | 39 | 4 | 36 | 48 | 12 |
| | 168 | 36 | 43 | 7 | 35 | 44 | 9 |
| 566 | 2 | −2 | 10 | 12 | 33 | 44 | 11 |
| | 6 | 11 | 37 | 26 | 43 | 51 | 8 |
| | 24 | 45 | 58 | 13 | 57 | 62 | 5 |
| | 72 | 56 | 64 | 8 | 58 | 61 | 3 |
| | 168 | 58 | 64 | 6 | 57 | 62 | 5 |

As can be seen from Table 2, by aging either of the alloys for 24 hours at a second aging temperature of 600° C., stable austenite transformation temperatures (both $A_s$ and $A_f$) can be achieved, (i.e. the $A_s$ and $A_f$ of each of the alloys after 24 hours aging at 600° C. does not deviate more than 10° C. upon thermally processing the nickle-titanium alloy under the same conditions for an additional 8 hours.) Further, the stable austenite transformation temperatures achieved after 24 hours aging at the second aging temperature of 600° C. are also independent of overall composition of the nickel-titanium alloy. That is, the $A_s$ of the 55 at. % Ni alloy is within 10° C. of the $A_s$ of the 52 at. % Ni alloy after thermally processing the alloys at a second aging temperature of 600° C. for 24 hours; and the $A_f$ of the 55 at. % Ni alloy is within 10° C. of the $A_f$ of the 52 at. % Ni alloy after thermally processing the alloys at a second aging temperature of 600° C. for 24 hours.

In comparison, although it appears after aging the alloys for 6 hours at a second aging temperature of 600° C., the $A_f$ of the 52 at. % Ni alloy and the $A_s$ and $A_f$ of the 55 at. % Ni alloy are stable, the austenite start temperatures are not independent of overall composition. Further, after 2 hours aging at the second aging temperature of 600° C., neither the $A_s$ nor $A_f$ of the 52 at. % Ni alloy is stable and the austenite start temperatures are not independent of overall composition.

Although not limiting herein, it is believed that the amount of nickel in solid solution in the TiNi phase in the 55 at. % Ni alloy before aging at the second aging temperature was closer to the solid solubility limit of nickel in the TiNi phase at 600° C. than for the 52 at. % Ni alloy. Therefore, the aging time at 600° C. required to achieve stable austenite transformation temperatures for the 55 at. % nickel alloy was less than for the 52 at. % Ni alloy. However, as indicated by Table 2, austenite transformation temperatures that are both stable and independent of overall composition can be achieved by aging the alloys for 24 hours at 600° C. Therefore, the same thermal processing can be used for both alloys without regard to the initial condition of the alloy.

As can be seen from Table 2, by aging either of the alloys for 72 hours at a second aging temperature of 566° C., stable austenite transformation temperatures (both $A_s$ and $A_f$) can be achieved, (i.e. the $A_s$ and $A_f$ of each of the alloys after 72 hours aging at 566° C. does not deviate more than 10° C. upon thermally processing the nickel-titanium alloy under the same conditions for an additional 8 hours.) Further, the stable austenite transformation temperatures achieved after 72 hours aging at the second aging temperature 566° C. are also independent of overall composition of the nickel-titanium alloy. That is, the $A_s$ of the 55 at. % Ni alloy is within 10° C. of the $A_s$ of the 52 at. % Ni alloy after thermally processing the alloys at a second aging temperature of 566° C. for 72 hours; and the $A_f$ of the 55 at. % Ni alloy is within 10° C. of the $A_f$ of the 52 at. % Ni alloy after thermally processing the alloys at a second aging temperature of 566° C. for 72 hours.

In comparison, although it appears after aging the alloys for 24 hours at a second aging temperature of 566° C., the $A_f$ of the 52 at. % Ni alloy and the $A_s$ and $A_f$ of the 55 at. % Ni alloy are stable, the austenite start temperatures are not independent of overall composition. Further, from 2 to 6 hours aging at the second aging temperature of 566° C., the austenite transformation temperatures are neither stable nor independent of overall composition.

Further, as indicated in Table 2, the stable austenite transformation temperatures ($A_s$ and $A_f$) achieved after aging the nickel-titanium alloys for 24 hours at 600° C. are lower than the stable transformation temperatures achieved after aging the nickel-titanium alloys for 24 hours at 566° C. Although not meant to be bound by any particular theory, as previously discussed, this is believed to be attributable to the different solid solubility limit for nickel in the TiNi phase at 600° C. than at 566° C. In other words, the characteristic austenite transformation temperatures for nickel-titanium alloys having an equilibrium amount of nickel in solid solution in the TiNi phase at 600° C. are lower than the characteristic austenite transformation temperatures for nickel-titanium alloys having an equilibrium amount of nickel in solid solution in the TiNi phase at 566° C.

Moreover, as indicated in Table 2, the austenite transformation temperature range generally tends to narrow with increasing aging time at a given aging temperature for both alloys. As previously discussed with respect to austenite transformation temperatures, the relatively small fluctuations in the austenite transformation temperature range for the 55 at. % Ni alloy aged at 600° C. is believed to be attributable to the alloy having an amount of nickel in solid solution in the TiNi phase that is close to the solid solubility limit before aging at 600° C.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

The invention claimed is:

1. A method of processing a nickel-titanium alloy comprising from greater than 50 up to 55 atomic percent nickel to provide a desired austenite transformation temperature, the method comprising:

selecting the desired austenite transformation temperature; and thermally processing the nickel-titanium alloy to adjust an amount of nickel in solid solution in a TiNi phase of the alloy such that a stable austenite transformation temperature is reached during thermally processing the nickel-titanium alloy, wherein the stable austenite transformation temperature is essentially equal to the desired austenite transformation temperature, wherein the nickel-titanium alloy comprises sufficient nickel to reach a solid solubility limit during thermally processing the nickel-titanium alloy.

2. The method of claim 1, wherein the desired austenite transformation temperature ranges from −100° C. to 100° C.

3. The method of claim 1, wherein after thermally processing the nickel-titanium alloy, the stable austenite transformation temperature of the nickel-titanium alloy is independent of overall composition of the nickel-titanium alloy.

4. The method of claim 1, wherein thermally processing the nickel-titanium alloy includes isothermally aging the nickel-titanium alloy.

5. The method of claim 4, wherein the nickel-titanium alloy is isothermally aged at a temperature of 500° C. to 800° C.

6. The method of claim 1, wherein thermally processing the nickel-titanium alloy includes isothermally aging the nickel-titanium alloy for at least 2 hours.

7. The method of claim 1, wherein thermally processing the nickel-titanium alloy includes isothermally aging the nickel-titanium alloy for at least 24 hours.

8. The method of claim 1, wherein thermally processing the nickel-titanium alloy includes aging the nickel-titanium alloy at a first aging temperature and subsequently aging the nickel-titanium alloy at a second aging temperature, the first aging temperature being higher than the second aging temperature.

9. The method of claim 8, wherein the first aging temperature ranges from 600° C. to 800° C. and the second aging temperature ranges from 500° C. to 600° C.

10. The method of claim 8, wherein the nickel-titanium alloy reaches the stable austenite transformation temperature during aging at the second aging temperature.

11. The method of claim 1, wherein thermally processing the nickel-titanium alloy includes aging the nickel-titanium alloy at a first aging temperature and subsequently aging the nickel-titanium alloy at a second aging temperature, the first aging temperature being lower than the second aging temperature.

12. The method of claim 11, wherein the first aging temperature ranges from 500° C. to 600° C. and the second aging temperature ranges from 600° C. to 800° C.

13. The method of claim 11, wherein the nickel-titanium alloy reaches the stable austenite transformation temperature during aging at the second aging temperature.

14. The method of claim 1, wherein the nickel-titanium is a binary nickel-titanium alloy.

15. The method of claim 1, wherein the nickel-titanium alloy further comprises at least one additional alloying element.

16. The method of claim 15, wherein the at least one additional alloying element is selected from the group consisting of copper, iron, and hafnium.

17. A method of processing a nickel-titanium alloy to provide a desired austenite transformation temperature, the method comprising:

selecting a nickel-titanium alloy comprising from greater than 50 up to 55 atomic percent nickel;

selecting the desired austenite transformation temperature; and thermally processing the selected nickel-titanium alloy to adjust an amount of nickel in solid solution in a TiNi phase of the alloy such that a stable austenite transformation temperature is reached during thermally processing the selected nickel-titanium alloy, the stable austenite transformation temperature being essentially equal to the desired austenite transformation temperature; and wherein the selected nickel-titanium alloy comprises sufficient nickel to reach a solid solubility limit during thermally processing the selected nickel-titanium alloy.

18. The method of claim 17, wherein after thermally processing the nickel-titanium alloy, the stable austenhte transformation temperature of the nickel-titanium alloy is independent of overall composition of the nickel-titanium alloy.

19. A method of processing a nickel-titanium alloy comprising from greater than 50 up to 55 atomic percent nickel to achieve a desired austenite transformation temperature range, the method comprising isothermally aging the nickel-titanium alloy in a furnace at a temperature ranging from 500° C. to 800° C. for at least 2 hours, wherein after aging the nickel-titanium alloy has an austenite transformation temperature range no greater than 15° C.

20. The method of claim 19, wherein after aging the austenite transformation temperature range is no greater than 10° C.

21. The method of claim 19, wherein after aging the austenite transformation temperature range is no greater than 6° C.

22. The method of claim 19, wherein the nickel-titanium alloy is a binary nickel-titanium alloy.

23. The method of claim 19, wherein the nickel-titanium alloy further comprises at least one additional alloying element.

24. The method of claim 23, wherein the at least one additional alloying element is selected from the group consisting of copper, iron, and hafnium.

25. A method of processing a nickel-titanium alloy comprising from greater than 50 up to 55 atomic percent nickel to achieve a desired austenite transformation temperature range, the method comprising:

aging the nickel-titanium alloy in a furnace at a first aging temperature to achieve a stable auslenite transformation temperature; and aging the nickel-titanium alloy at a second aging temperature that is different than the first aging temperature, wherein after aging at the second aging temperature, the nickel-titanium alloy has an austenite transformation temperature range that is essentially equal to the desired transformation temperature range.

26. The method of claim 25, wherein the second aging temperature is lower than the first aging temperature.

27. The method of claim 25, wherein the second aging temperature is higher than the first aging temperature.

28. The method of claim 25, wherein the austenite transformation temperature range achieved after aging the nickel-titanium alloy at the second aging temperature is greater than an austenite transformation temperature range achieved after aging the nickel-titanium alloy at the first aging temperature.

* * * * *